US007231683B1

(12) United States Patent
Cruz

(10) Patent No.: US 7,231,683 B1
(45) Date of Patent: Jun. 19, 2007

(54) WINDOW CLEANING APPARATUS

(76) Inventor: Luis Carlos Cruz, 150-29 107th Ave., Jamaica, NY (US) 11433

( * ) Notice: Subject to any disclaimer, the term of this patent is extended or adjusted under 35 U.S.C. 154(b) by 234 days.

(21) Appl. No.: 10/653,498

(22) Filed: Sep. 2, 2003

(51) Int. Cl.
*B06S 1/20* (2006.01)
*B06S 1/56* (2006.01)
*B06S 1/44* (2006.01)
*A47L 1/02* (2006.01)

(52) U.S. Cl. ..... 15/103; 15/250.11; 15/250.24; 15/250.29; 15/250.01

(58) Field of Classification Search ..... 15/250.11, 15/103, 250.24, 250.29, 250.01
See application file for complete search history.

(56) References Cited

U.S. PATENT DOCUMENTS

| | | | | |
|---|---|---|---|---|
| 893,231 | A | 7/1908 | Fluegelman | |
| 940,135 | A * | 11/1909 | Edman | 15/250.15 |
| 1,232,815 | A | 7/1917 | Lapedes | |
| 1,561,801 | A | 11/1925 | Shipley | |
| 1,629,201 | A | 5/1927 | Christeler | |
| 2,563,696 | A | 8/1951 | Wayne | |
| 2,648,087 | A * | 8/1953 | Kiker, Jr. | 15/250.22 |
| 2,740,151 | A | 4/1956 | Wayne | |
| 3,080,592 | A * | 3/1963 | Hassage | 15/98 |
| 3,218,663 | A | 11/1965 | Battista | |
| 3,298,052 | A | 1/1967 | Wolfe | |
| 3,378,875 | A * | 4/1968 | Kern | 15/250.04 |
| 3,454,976 | A | 7/1969 | Kijinski | |
| 3,461,476 | A * | 8/1969 | North | 15/250.04 |
| 3,999,242 | A | 12/1976 | Maruyama et al. | |
| 4,198,724 | A * | 4/1980 | Fisher et al. | 15/302 |
| 4,257,138 | A * | 3/1981 | Clements et al. | 15/4 |
| 5,020,180 | A | 6/1991 | Mimura | |
| 5,465,446 | A * | 11/1995 | Chang | 15/50.3 |
| 5,655,247 | A | 8/1997 | Allen et al. | |
| 6,851,156 | B1 * | 2/2005 | Hairaton | 15/250.01 |
| 6,986,186 | B1 * | 1/2006 | Dube | 15/250.01 |

* cited by examiner

*Primary Examiner*—Gary K. Graham
(74) *Attorney, Agent, or Firm*—Michael I Kroll

(57) ABSTRACT

The present invention discloses an apparatus for cleaning a window of a structure. The window cleaning apparatus includes a guide track mounted on one side of a window frame and a second guide track mounted on a side of the window frame opposite the first guide track wherein a cleaning assembly is retained and guided between and along a length of the first and second guide tracks. The apparatus further includes a means for selectively moving the cleaning assembly along the length of the guide track and over a surface of a window within the window frame thereby cleaning the surface of the window.

11 Claims, 10 Drawing Sheets

WINDOW CLEANING APPARATUS

BACKGROUND OF THE INVENTION

1. Field of the Invention

The present invention relates generally to cleaning devices and, more specifically, to a window cleaning apparatus mounted on an exterior of a window frame within tracks connected to a structure. The window cleaning apparatus is selectively operable from the interior of the structure. As the apparatus moves along the tracks, cleaning fluid is dispensed from dispensing jets positioned along a bottom side thereof. A brush element extends between distal ends of the apparatus for removing debris from the window panes. The window is further cleaned by a sponge element positioned vertically above the brush element. Thereafter a drying element contacts the window pane and dries the window.

2. Description of the Prior Art

Numerous other devices designed for cleaning windows are found in the prior art. Typical of these is U.S. Pat. No. 893,231 issued to Fluegelman on Jul. 14, 1908.

Another patent was issued to Lapedes on Jul. 10, 1917 as U.S. Pat. No. 1,232,815. Yet another U.S. Pat. No. 1,561,801 was issued to Shipley on Nov. 17, 1925 and still yet another was issued on May 17, 1927 to Christeler as U.S. Pat. No. 1,629,201.

Another patent was issued to Wayne on Aug. 7, 1951 as U.S. Pat. No. 2,563,696. Yet another U.S. Pat. No. 2,740,151 was issued to Wayne on Apr. 3, 1956. Another was issued to Battista on Nov. 23, 1965 as U.S. Pat. No. 3,218,663 and still yet another was issued on Jan. 17, 1967 to Wolfe as U.S. Pat. No. 3,298,052.

Another patent was issued to Kijinski on Jul. 15, 1969 as U.S. Pat. No. 3,454,976. Yet another U.S. Pat. No. 3,999,242 was issued to Maruyama et al. on Dec. 28, 1976. Another was issued to Mimura on Jun. 4, 1991 as U.S. Pat. No. 5,020,180 and still yet another was issued on Aug. 12, 1997 to Allen et al. as U.S. Pat. No. 5,655,247.

While these cleaning devices may be suitable for the purposes for which they were designed, they would not be as suitable for the purposes of the present invention, as hereinafter described.

U.S. Pat. No. 893,231

Inventor: Isidor Fluegelman

Issued: Jul. 14, 1908

In a window cleaning device, a carriage adapted for attachment to a window sill, a tower or upright carried thereby, rotatable washing and drying elements carried by said tower, means adapted to rotate said washing and drying elements, a pump on said carriage adapted to supply water to said washing element, and means carried by said carriage adapted to actuate said pump and said washing and drying elements simultaneously.

U.S. Pat. No. 1,232,815

Inventor: Abraham Lapedes

Issued: Jul. 10, 1917

A window cleaning device embodying a frame having spaced upstanding sections for receiving a sash therebetween, bearings slidable along said sections, cleaning members movably carried by said bearings, a flexible connection between the bearings for reciprocating them, and a flexible connection between the cleaning members for moving them relatively to the bearings at the various positions thereof.

U.S. Pat. No. 1,561,801

Inventor: Elmer E. Shipley

Issued: Nov. 17, 1925

A window cleaning device of the character set forth, comprising an extensible bracket adapted to be removably attached transversely of a window, a brush supported by the bracket with its bristle directed toward the panels of the window, and a fabric wiper yielding supported against the panels of the window by the bristles of the brush.

U.S. Pat. No. 1,629,201

Inventor: Marie Christeler

Issued: May 17, 1927

A device of the class described comprising a carriage, a guide post, a pad slidably supported thereon, said guide post being pivoted to said carriage, a grooved pulley at the upper end of said post, a pair of grooved pulleys at the lower end of said post, cables trained on said pulleys attached to said pad for reciprocating the latter, a strap mounted on said carriage, and flexible means in said strap for normally retaining the guide post in upright position when positioned adjacent a window.

U.S. Pat. No. 2,563,696

Inventor: Douglas N. Wayne

Issued: Aug. 7, 1951

A surface: treating apparatus comprising a plurality of rotatable vertically disposed screws anchored on a window sash, traveling members received on said screws for vertical movement, means for rotating said screws, a liquid container supported by said traveling members and having delivery orifices, a vertically slidable plunger workable in said container, a plurality of spaced parallel operating rods carried by sand plunger and slidably mounted on said container, said plunger normally closing said orifices, a contact plate secured to each of said rods and engageable with a stop to actuate said plunger at a predetermined point during the raising movement of said traveling members to urge the plunger downwardly in the container, means for urging the plunger upwardly during the lowering of the container to force a liquid from said orifices, and surface cleaning means carried by said container.

U.S. Pat. No. 2,740,151

Inventor: Douglas N. Wayne

Issued: Apr. 3, 1956

In a window cleaning apparatus including a frame having upper and lower portions, a pair of spaced parallel screws rotatably supported by said portions, a horizontally disposed chemically impregnated roller extending between said screws, means vertically adjustably carried by said screws said supporting said roller, and means operatively engaged with said roller and actuated upon engagement with one of said portions for rotating the roller in a step by manner U.S. Pat. No. 3,218,663

Inventor: Joseph Battista

Issued: Nov. 23, 1965

An automatic washing device for washing any one of a plurality of substantially flat surfaces of different planar dimension comprising a washing unit and a control unit, means for supporting said washing unit on said control unit for controlled movement toward and away from said control unit between peripheral limits defining one of said planar dimensions of a surface being washed, means for supporting said control unit for controlled movement between peripheral limits defining the other of said planar directions of a surface being washed, and means responsive to the movement of said washing unit from one of its peripheral limits to the other for moving the said control unit a predetermined distance.

U.S. Pat. No. 3,298,052

Inventor: Max G. Wolfe

Issued: Jan. 17, 1967

In a window washing apparatus for modern skyscrapers, the combination of a frame, mechanism carried on said frame for washing windows, mechanism carried on said frame for drying windows and means carried on said frame for wiping said windows, the frame comprising a pair of vertical corner legs, a pair of vertical plates, a plurality of horizontal bars rigidly connected to said vertical legs and plates, a caster wheel on the lower end of each of said legs and plates, means on said frame for slidable movement along a building wall, a plurality of bearing block assemblies secured to each of said plates for supporting said window washing mechanism and said window drying mechanism, said window washing mechanism comprising a horizontal washer roller assembly, said washer roller assembly comprising a shaft supported at its opposite ends in one of said bearing block assemblies on each of said plates, a plurality of radially-extending bristles on said shaft, the lowermost ends of the lower of said bristles extending downwardly into a water tank mounted between said plates on said frame, said window drying mechanism comprising a horizontal drying roller assembly, said drying roller assembly comprising a shaft supported at its opposite ends in another of said bearing block assemblies on 'each of said plates' a hollow cylinder having inwardly-extending spokes secured to a pair of central hubs being supported on said drying roller shaft, said cylinder-: having a plurality of openings through the cylindrical side thereof, a sleeve fitted over said cylinder, said sleeve being made from a water absorbing material, and means for blowing water vapor outwardly from within said hollow cylinder.

U.S. Pat. No. 3,454,976

Inventor: Gerald Kijinski

Issued: Jul. 15, 1969

A window cleaning apparatus for cleaning a planar surface comprising a first plurality of parallel worm gears, means for driving said worm gears in synchronism and in an identical sense, a second plurality of threaded sleeve members equal in number to said first plurality of worm gears operatively mounted on said worm gears, a third plurality of means interconnecting said sleeve members for simultaneous displacement longitudinally of said plurality of worm gears in a first direction, said interconnecting means being rotatably mounted by said sleeve means, a cleaning block having scrubbing means and wiping means mounted by said interconnecting means about a common axis and fixedly connected thereto, means for reversibly rotating said cleaning block, means for limiting rotation of said cleaning block between positions in which said planar surface is alternately contacted by said scrubbing means and said wiper means, and means for reversing the direction of said interconnecting means from said first direction to an opposite direction.

U.S. Pat. No. 3,999,242

Inventor: Masahiko Maruyama et al

Issued: Dec. 28, 1976

An apparatus for cleaning windows and the like characterized by a housing containing a nozzle for injecting a cleaning solution and a brush being movable under contacting relation with the surface to be cleaned, wherein the end of the housing facing the surface to be cleaned is open to form an aperture and the aperture is closeable by a moveable edge of the housing. A wiper is disposed on the movable edge of the housing, being operating through an interlocking mechanism for moving the brush toward and away from the surface to be cleaned, whereby in the case of withdrawing the brush, the aperture of the housing is automatically closed so that the wiper may be fully utilized.

U.S. Pat. No. 5,020,180

Inventor: Noritaka Mimura

Issued: Jun. 4, 1991

A window-pane cleaning device for cleaning window-panes of a building is provided in a cleaning unit which is moved along a window of the building. The device includes a squeegee for cleaning a window-pane, an approaching and retraction servo device for moving the squeegee toward and away from the surface of the window-pane, an inclination angle adjusting servo device for adjusting the inclination angle of the squeegee, sensors for detecting the position and pressing force of the squeegee, and a control device responsive to detection outputs of the sensors for controlling the pressing force and inclination angle of the squeegee to predetermined values respectively at starting of cleaning, during continuous cleaning and finishing of cleaning.

U.S. Pat. No. 5,655,247

Inventor: Charles Allen et al

Issued: Aug. 12, 1997

A cleaning device for cleaning windows comprising an elongate wiper element 8 which is robotically controlled to move across the surface of the window to apply and remove cleaning fluid therefrom. The robotic control can be arranged so that the movement of the wiper element corresponds to that which it would follow if used manually by a skilled window cleaner. The wiper element maintains continuous contact with the entire surface of the window without displacement of the wiper from the surface of the window during cleaning.

SUMMARY OF THE PRESENT INVENTION

The present invention relates generally to cleaning devices and, more specifically, to a window cleaning apparatus mounted on an exterior of a window frame within tracks connected to a structure. The window cleaning apparatus is selectively operable from the interior of the structure. As the apparatus moves along the tracks, cleaning fluid is dispensed from dispensing jets positioned along a bottom side thereof. A brush element extends between distal ends of the apparatus for removing debris from the window panes. The window is further cleaned by a sponge element positioned vertically above the brush element. Thereafter a drying element contacts the window pane and dries the window.

A primary object of the present invention is to provide a window cleaning apparatus that overcomes the short comings of the prior art.

Another object of the present invention is to provide a window cleaning apparatus that is permanently mounted on structure having windows.

Still another object of the present invention is to provide a window cleaning apparatus that is mounted within a window frame.

Another object of the present invention is to provide a window cleaning apparatus that is selectively operable from within the interior of the structure.

Yet another object of the present invention is to provide a window cleaning apparatus that is operable by means of a chain or motor positioned on the exterior or interior of the structure.

Still yet another object of the present invention is to provide a window cleaning apparatus that can be engaged to clean the exterior of a window by means of a motor positioned within the housing of the cleaning apparatus.

Another object of the present invention is to provide a window cleaning apparatus including a housing positioned at a top or bottom of the window pane for storing of the cleaning apparatus.

Yet another abject of the present invention is to provide a window cleaning apparatus including guide tracks mounted vertically within the window frame for guiding the cleaning apparatus along the surface of the window.

Still yet another object of the present invention is to provide a window cleaning apparatus having a sensor means for engaging and de-engaging the cleaning apparatus with the window pane.

Another object of the present invention is to provide a window cleaning apparatus including at least one of a brush, sponge and squeegee blades for cleaning a window pane.

Still another object of the present invention is to provide a window cleaning apparatus that is simple and easy to use.

Still yet another object of the present invention is to provide a window cleaning apparatus that is inexpensive to manufacture and use.

Additional objects of the present invention will appear as the description proceeds.

The present invention overcomes the shortcomings of the prior art by providing a window cleaning device mounted to the exterior of a window opening. The device has a cover element with a window cleaning apparatus therein. The window cleaning apparatus can be selectively operable from the interior of the structure by means of a motor connected to the window cleaning apparatus for moving the cleaning apparatus along the surface of the window pane. The apparatus moves along guide tracks fixedly positioned to opposing sides of the window opening. Cleaning fluid is dispensed from jets positioned along the bottom of the apparatus. Thereafter, a brush element removes debris from the window and a sponge washes the window. The cleaning apparatus dries the window using a plastic blade thereby completing the cleaning process.

The foregoing and other objects and advantages will appear from the description to follow. In the description reference is made to the accompanying drawing, which forms a part hereof, and in which is shown by way if illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
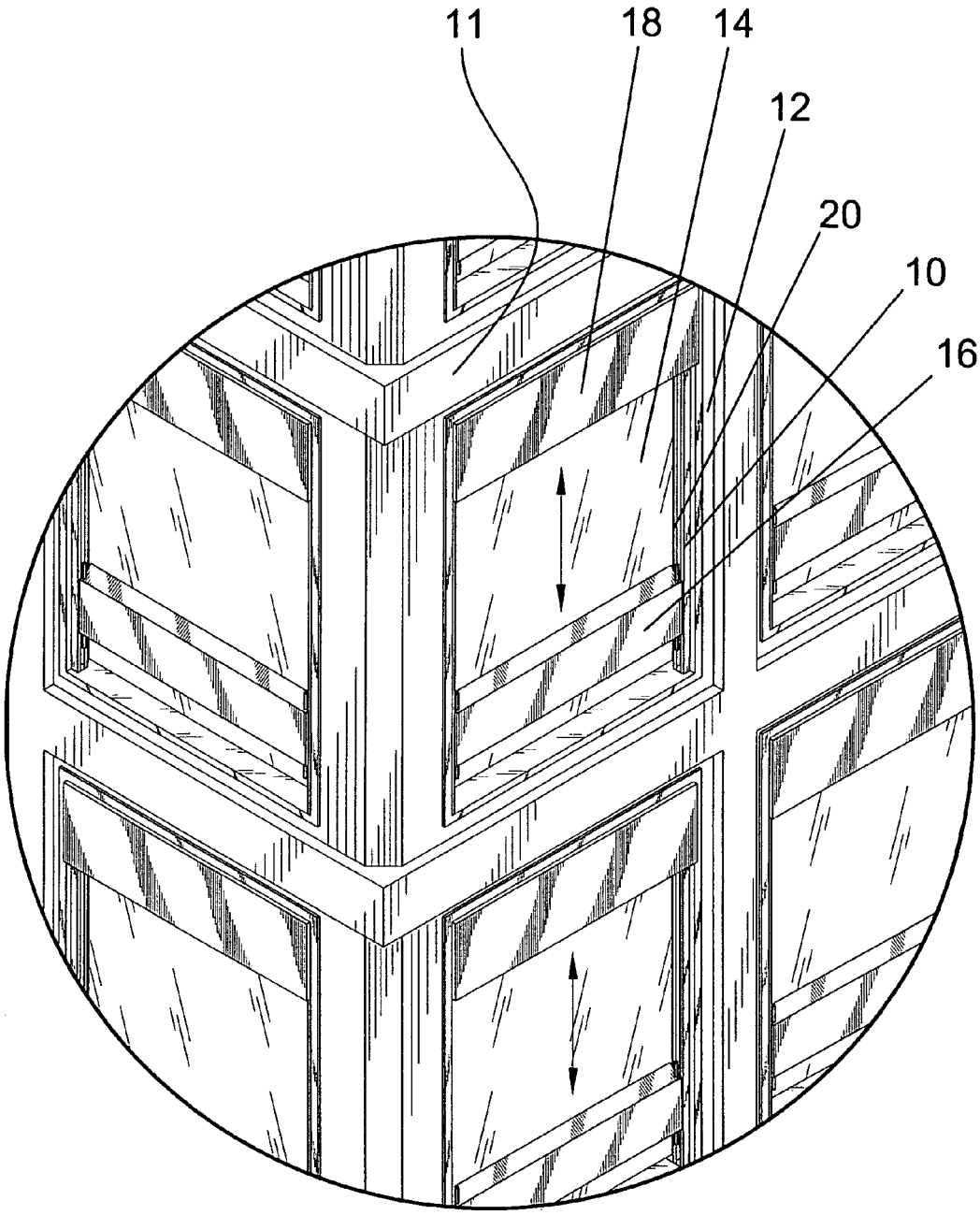
FIG. 1 is an illustration view of the window cleaning apparatus of the present invention positioned on the exterior of a structure within a window frame therein.

Turning now descriptively to the drawings, in which similar reference characters denotes similar elements throughout the several views, the Figures illustrate the window cleaning apparatus of the present invention. With regard to the reference numerals used, the following numbering is used throughout the various drawing figures.

10 window cleaning apparatus of the present invention
11 structure
12 window frame
14 window pane
16 cleaning assembly
17 rollers
18 storage compartment
20 guide track
21 channel
22 dispensing jets
23 cleaning fluid supply
24 filling tube
26 support rod
28 bearing
30 balance spring
32 balance spring
33 first pulley
34 transfer chain
36 double pulley
38 operation chain
40 fluid inputs
42 push rod
44 brush element
46 sponge element
48 drying element
50 reservoir
51 cleaning fluid
52 tension spring
54 extenders
60 internal motor
62 power source
64 wires
66 motor
68 drive shaft
70 operation gear
72 central drive gear
76 distal drive gear

DETAILED DESCRIPTION OF THE PREFERRED EMBODIMENT

The following discussion describes in detail one embodiment of the invention. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 10 illustrate a window cleaning apparatus of the present invention indicated generally by the numeral 10.

FIG. 1 is an illustrative view of the window cleaning apparatus 10 of the present invention positioned on the exterior of a structure 111 within a window frame 12 therein. The window cleaning apparatus 10 is used to preferably clean the exterior of a window pane 14 of a structure 11. The window cleaning apparatus 10 includes a cleaning assembly 16 mounted within a window frame 12 of the structure 11. A guide track 20 is positioned to extend vertically along each elongated side of the window frame 12. The cleaning assembly 16 is mounted between the guide tracks 20 and is selectively moveable along the length thereof. Positioned at a top end of the window frame 12 is a storage compartment 18 for selectively storing the cleaning assembly 16 when the cleaning assembly 16 is not in use. Upon activation of the window cleaning apparatus 10, the cleaning assembly 16 moves out from the storage compartment 18 and engages the window pane 14 for cleaning thereof. The method in which the cleaning assembly 16 cleans the window pane 14 will be discussed hereinafter with specific reference to FIGS. 2–9.

In FIG. 1, the storage compartment 18 is shown positioned at the top of the window frame 12. Such position is illustrated for purposes of example only. Alternatively, the storage compartment 18 can be positioned at a bottom end of the window frame 12 for storing the cleaning assembly. Also, positioning the guide tracks 20 along the elongated sides of the window frame 12 thereby causing the cleaning assembly 16 to move vertically along the surface of the window pane 14 is shown for purposes of example only. Alternatively, the guide tracks can be positioned along the horizontal, shorter edges of the window frame 12 thereby causing the cleaning assembly to move horizontally over the surface of the window pane 14.

Figure 2:
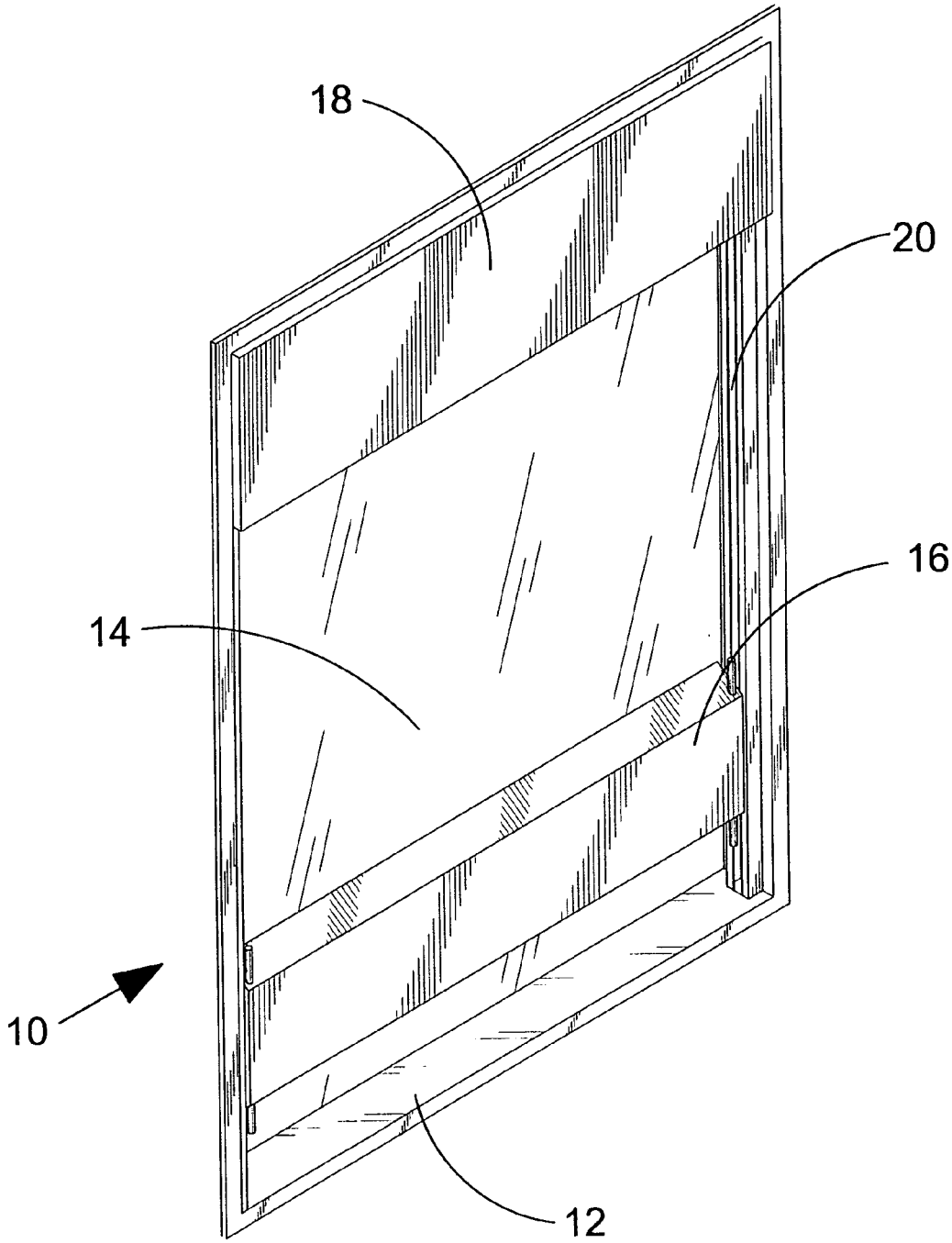
FIG. 2 is a perspective view of the window cleaning apparatus of the present invention positioned within a window frame.

FIG. 2 is a perspective view of the window cleaning apparatus of the present invention positioned within the window frame 12 of a structure 11. FIG. 2 shows a single window frame 12 including the guide tracks 20 connected to and extending along the vertical supports of the window frame 12. The cleaning assembly 16 is mounted between the guide tracks 20 and is positioned adjacent to the exterior surface of the window pane 14. While, only one window cleaning apparatus is shown in FIG. 2, it is preferable that the structure 11 includes a plurality of window frames 12 each respective window frame having a window pane 14. It is also preferable that each respective window frame have a cleaning assembly connected between the guide tracks 20 mounted within each window frame 12.

Each window cleaning apparatus 10 of the present invention is selectively operable from within the structure thereby allowing a user to selectively determine when the exterior of the window pane 14 is to be cleaned. Alternatively, the window cleaning apparatus 10 can be connected to a timing device which selectively schedules when the window cleaning apparatus 10 will be activated and caused to clean the exterior of the window pane 14. The method by which the window cleaning apparatus is operated will be discussed hereinafter with specific reference to FIGS. 4, 5 and 10.

Figure 3:
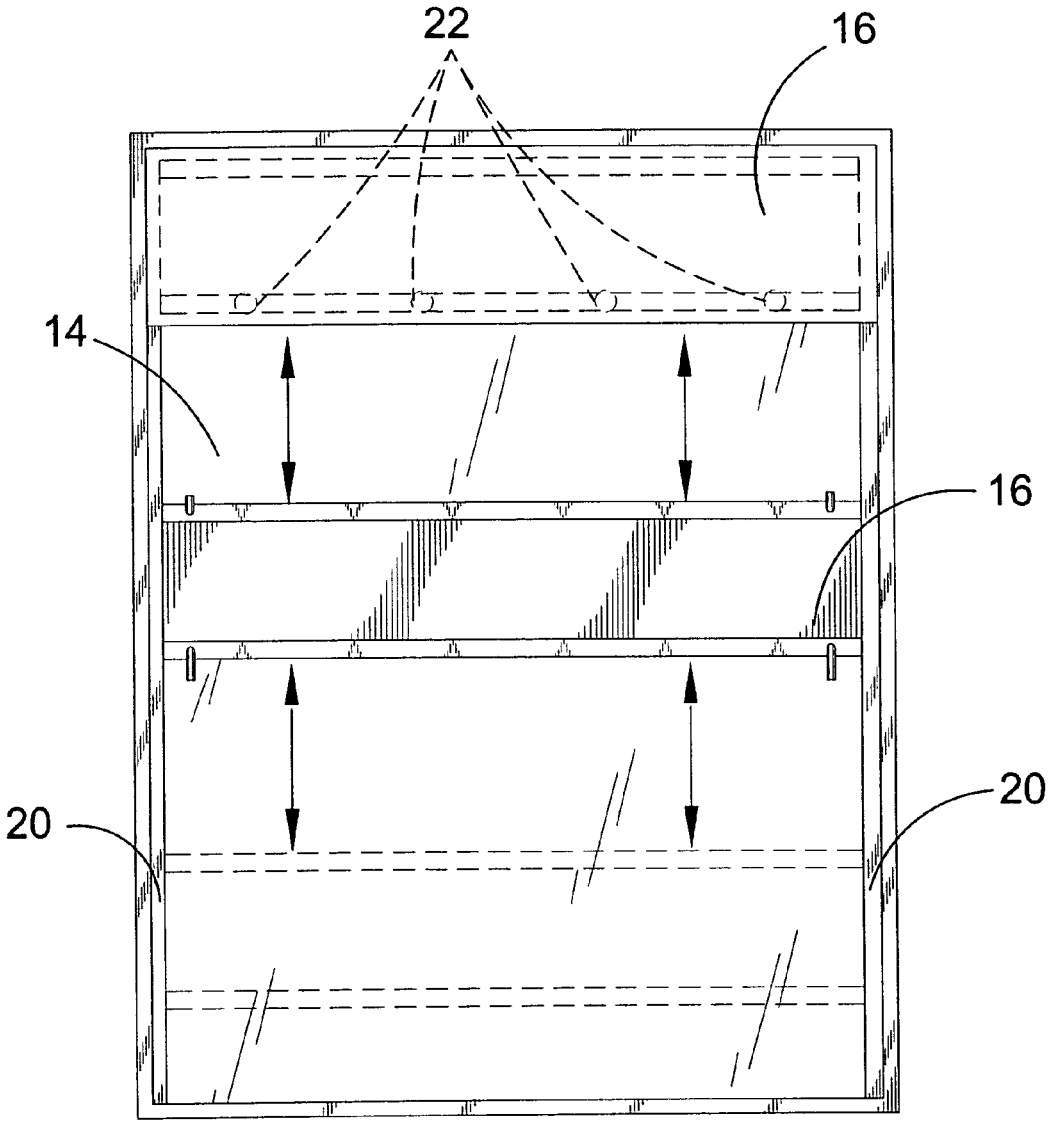
FIG. 3 is a front view of the window cleaning apparatus of the present invention shown moving along the tracks to clean a window.

FIG. 3 is a front view of the window cleaning apparatus 10 of the present invention cleaning a window pane 14. The cleaning assembly 16 of the window cleaning apparatus is shown in phantom stored within the storage compartment 18. Therein, the cleaning assembly 16 includes dispensing jets 22 positioned along a bottom end thereof. The dispensing jets 22 selectively dispense cleaning fluid on the surface of the window pane 14. The dispensing jets can be set to dispense cleaning fluid at a constant rate as the cleaning assembly moves vertically over the surface of the window pane 14. Alternatively, the dispensing jets 22 can be set to dispense a pre-determined amount of cleaning fluid upon the initial activation of the apparatus 10 thereby allowing gravity to cause the dispensed cleaning fluid to flow downwards over the window pane 14. Thereafter the cleaning mechanism of the cleaning assembly 16 selectively cleans the exterior surface of the window pane 14. The cleaning assembly 16 moves vertically from the storage compartment 18 to the bottom of the window frame 12. Upon reaching the bottom of the window frame 12, the cleaning assembly 18 is retracted in a direction towards the storage compartment 18. The cleaning assembly 16 is then stored for later within the storage compartment 18. Also, when the cleaning assembly 16 is stored in the storage compartment 18, the cleaning assembly 16 is able to receive a refill of cleaning fluid, as will be discussed with specific reference to FIG. 4.

Figure 4:
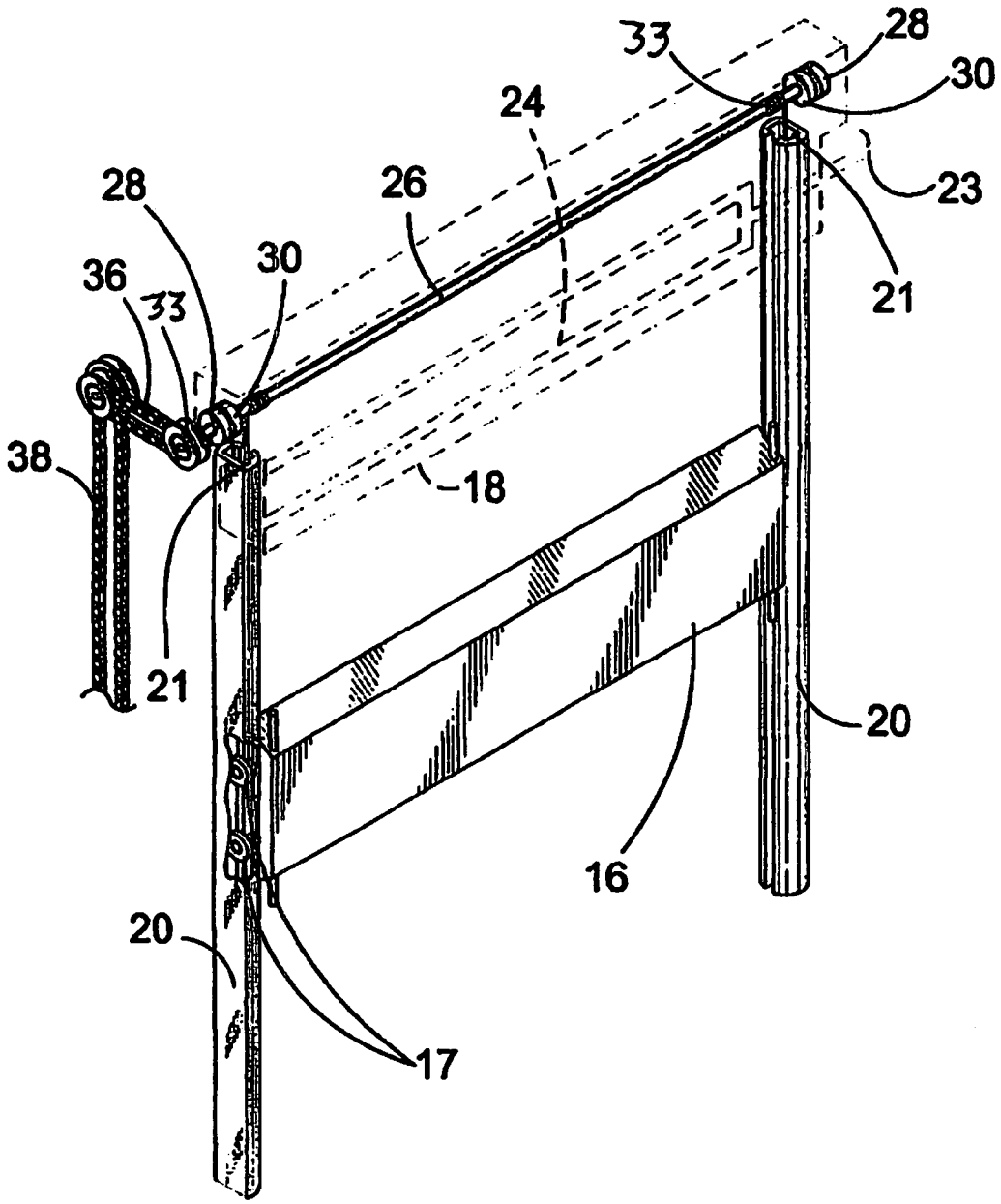
FIG. 4 is a perspective view of the window cleaning apparatus of the present invention and the operation mechanism for controlling the window cleaning apparatus.

FIG. 4 is a perspective view of the window cleaning apparatus 16 of the present invention and the operation mechanism for controlling the window cleaning apparatus. The operating mechanism which selectively controls the window cleaning apparatus 16 as shown in FIG. 4 is a chain-based mechanism. This chain based mechanism is described for purposes of example only and any mechanism whereby the cleaning assembly can move vertically along the surface of the window pane 14 can be used.

The storage compartment 18 is shown in phantom and functions to protect the operating mechanism of the window cleaning apparatus 10 of the present invention when not in use. The guide tracks 20 are shown partially extending into the storage compartment 18. The guide tracks 20 each a channel 21 extending along a length thereof. The cleaning assembly 16 is mounted between the guide tracks 20 by rollers 17. The rollers 17 allow the cleaning assembly 16 to move along the length of the guide tracks 20 thereby allowing the cleaning assembly to move along the surface of the window pane 14. The storage compartment 18 also includes distribution tubes 24 which extend from a supply tube 23. The supply tube 23 supplies cleaning fluid to the distribution tubes 24 for selectively providing refills of cleaning fluids to the cleaning assembly 16.

The operating mechanism which operates the cleaning assembly 16 includes a support rod 26. The support rod 26 is positioned within the storage compartment 18 adjacent to the window frame 12. Positioned at each distal end of the rod 26 is a bearing 28. A balance spring 30 is connected between the bearing 28 is adjacent of the rod 26. A lifting element 32 is wrapped around the rod 26 on a side of the balance spring 30 opposite the bearing 28. The lifting element extends from the rod 26 and extends through the channel 21. The lifting element 32 is connected to the rollers 17, and upon rotation of the rod 26, determines which direction the rollers move along the channel 21.

The rod 26 is rotated by a pulley system. The pulley system includes a first pulley 33 connected to a first end of the rod 26. A second dual pulley 36 is positioned within the structure 11 or on a side of a wall of the structure opposite the first pulley at a predetermined distance from the first pulley 33. The first pulley 33 and the second dual pulley 36 are connected by a transfer chain 34. A power chain 38 connects the dual pulley 36 to a motor (not shown). Upon activation of the motor, the power chain 38 is rotated by the motor causing the dual pulley 36 to also rotate. Rotation of the dual pulley 36 causes the transfer chain 34 to rotate the first pulley 33. The first pulley 33 causes the rod 26 to rotate about the bearings 28 and cause the lifting element to be unwound from the rod 26. The rollers 17 then move along the channel of the aperture 21 of the guide track 20 thus causing the cleaning assembly 16 to move out from the storage compartment 18 and over the surface of the window pane 14 for cleaning thereof. The motor preferably operates to rotate the power chain 38 in either a clockwise or counter clockwise direction. Upon operating the motor in the opposite direction the pulleys 36, 33 are caused to rotated the rod 26 in the opposite direction thereby causing the rollers to be move in a direction towards the rod 26 by winding the lifting element therearound. This causes the cleaning assembly 16 to more towards and be stored in the storage compartment 18 after the window pane 14 has been cleaned.

Figure 5:
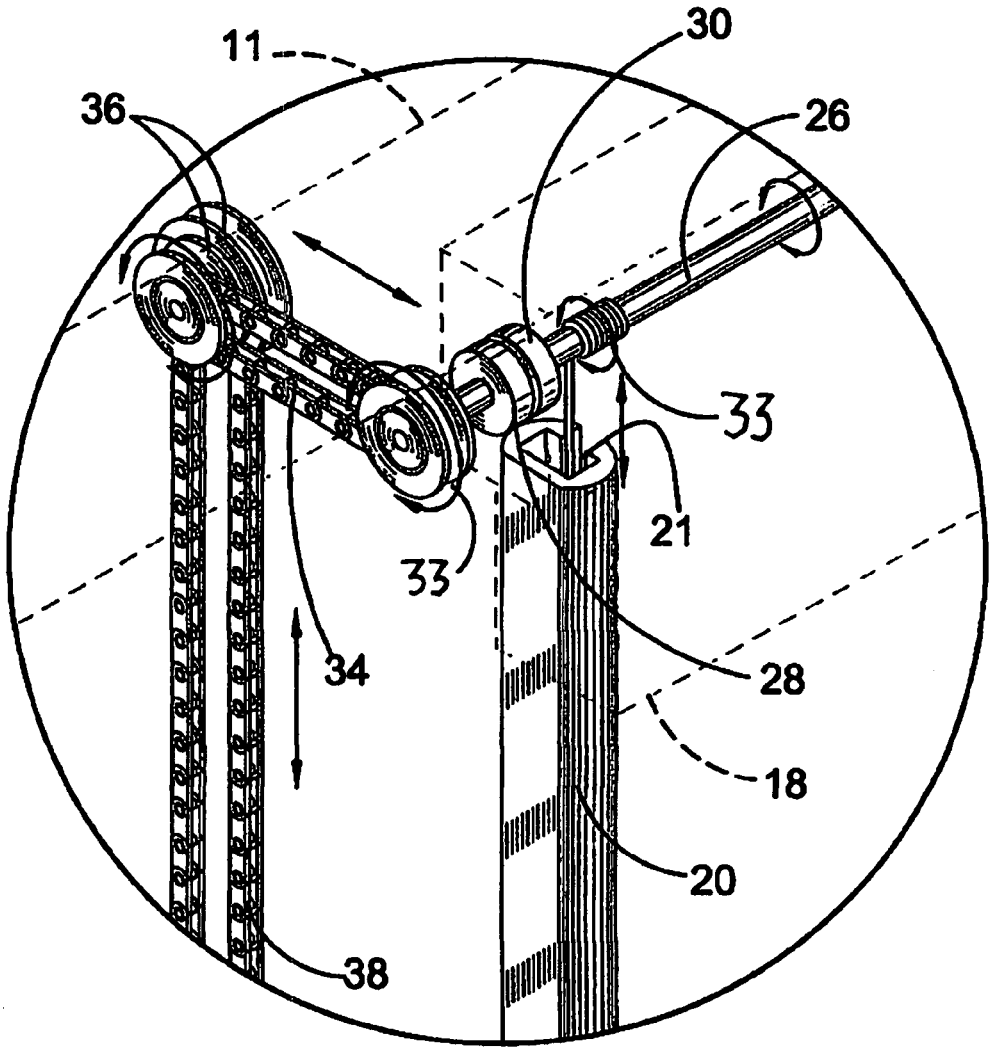
FIG. 5 is a perspective view of the operating mechanism of the window cleaning apparatus of the present invention.

FIG. 5 is a perspective view of the operating mechanism of the window cleaning apparatus of the present invention. The operating mechanism which operates the cleaning assembly 16 includes a support rod 26. The support rod 26 is positioned within the storage compartment 18 adjacent to the window frame 12. Positioned at each distal end of the rod 26 is a bearing 28. A balance spring 30 is connected between the bearing 28 is adjacent of the rod 26. A lifting element 32 is wrapped around the rod 26 on a side of the balance spring 30 opposite the bearing 28. The lifting element extends from the rod 26 and extends through the channel 21. The lifting element 32 is connected to the rollers 17, and upon rotation of the rod 26, determines which direction the rollers move along the channel 21.

The rod 26 is rotated by a pulley system. The pulley system includes a first pulley 33 connected to a first end of the rod 26. A second dual pulley 36 is positioned within the structure 11 or on a side of a wall of the structure opposite the first pulley at a predetermined distance from the first pulley 33. The first pulley 33 and the second dual pulley 36 are connected by a transfer chain 34. A power chain 38 connects the dual pulley 36 to a motor (not shown). Upon activation of the motor, the power chain 38 is rotated by the motor causing the dual pulley 36 to also rotate. Rotation of the dual pulley 36 causes the transfer chain 34 to rotate the first pulley 33. The first pulley 33 causes the rod 26 to rotate about the bearings 28 and cause the lifting element to be unwound from the rod 26. The rollers 17 then move along the channel of the aperture 21 of the guide track 20 thus causing the cleaning assembly 16 to move out from the storage compartment 18 and over the surface of the window pane 14 for cleaning thereof. The motor preferably operates to rotate the power chain 38 in either a clockwise or counter clockwise direction. Upon operating the motor in the opposite direction the pulleys 36, 33 are caused to rotated the rod 26 in the opposite direction thereby causing the rollers to be move in a direction towards the rod 26 by winding the lifting element therearound. This causes the cleaning assembly 16 to more towards and be stored in the storage compartment 18 after the window pane 14 has been cleaned.

Figure 6:
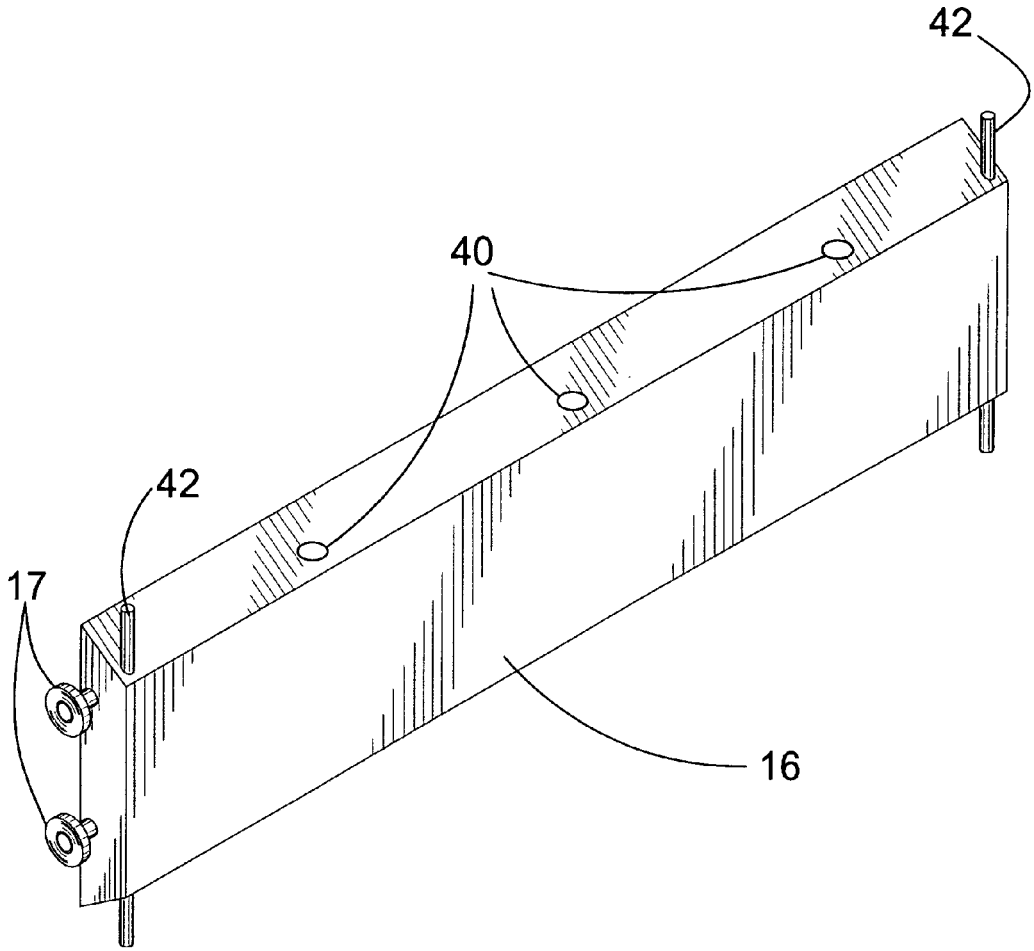
FIG. 6 is a perspective view of the cleaning assembly of the window cleaning apparatus of the present invention.
Figure 7:
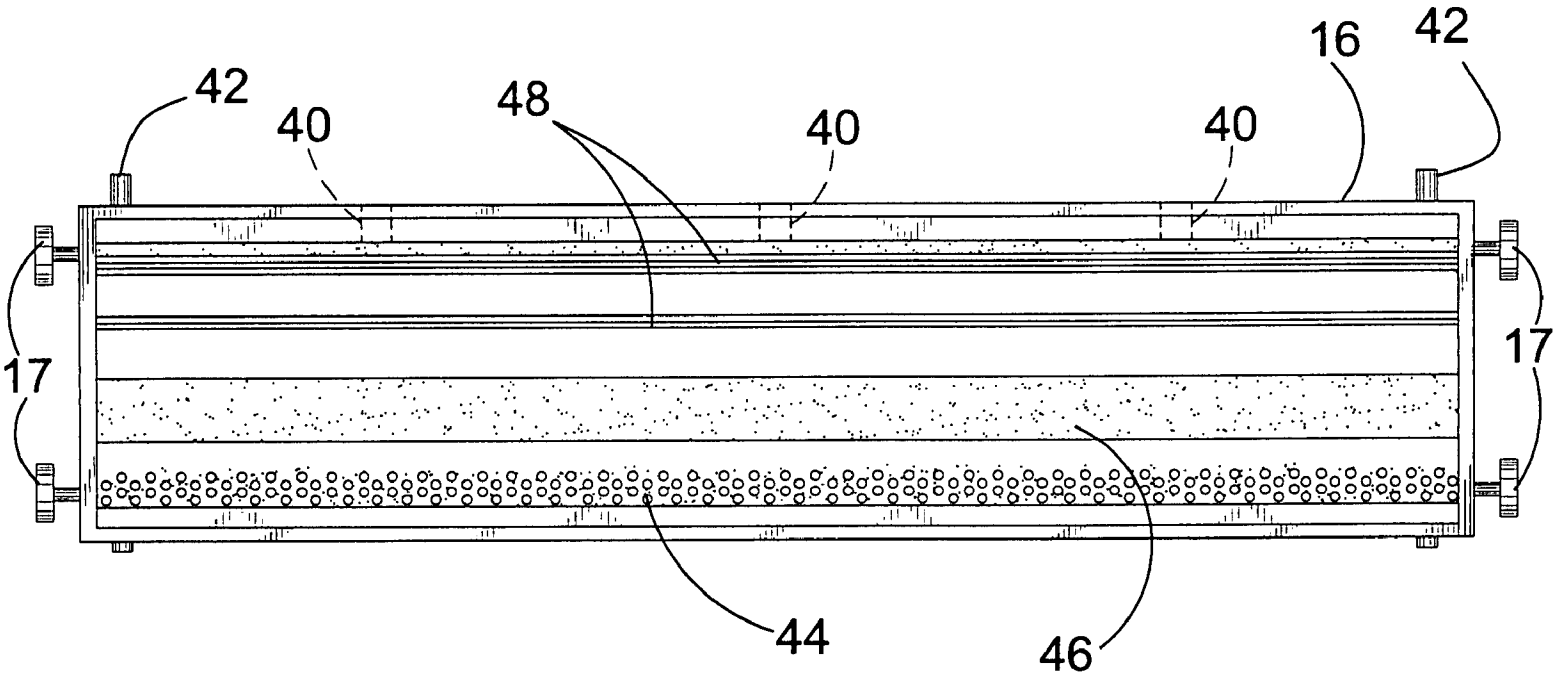
FIG. 7 is a front view of the cleaning assembly section of the window cleaning apparatus of the present invention which engages the window.

FIG. 6 is a perspective view of the cleaning assembly of the window cleaning apparatus of the present invention. The cleaning assembly 16 further includes a plurality fluid input ports 40 on a top side thereof. The fluid input ports 40 are able to receive cleaning fluid from the tubes 24 contained within the storage compartment 18. The cleaning fluid is supplied from the supply line 23 to tubes 24 and provided to the dispensing jets 22 contained on the cleaning assembly 16. Also shown in FIG. 6 are rods 42. The rods 42 are positioned on each distal end of the cleaning assembly 16 as can be seen in FIG. 7. The rods extend through a housing of the cleaning assembly 16 and are freely moveable within the housing. The rods 42 aid in engaging and disengaging the cleaning tools from the window pane 14. The cleaning tools will be discussed hereinafter with specific reference to FIG.

7. The method by which the cleaning tools in FIG. 7 are engaged and is engaged from the window pane 14 will be discussed with specific reference to FIGS. 8 and 9. When the rods 42 are in a first engaged position, the cleaning assembly is stored in the storage compartment 18. Upon activation of the cleaning apparatus 10, the cleaning tools of the cleaning apparatus 10 clean the window pane 14. Upon the cleaning assembly reaching the base of the window frame 12, the rods 42 are caused to move upward into a second is engaged position. Upon the rods entering the second disengaged position, the cleaning tools are disengaged from the window pane 14 and the cleaning assembly is caused to move upward in a direction towards the storage compartment. The movement of the cleaning assembly 16 is discussed above with specific reference to FIGS. 4 and 5. Upon reaching the storage compartment 18, the rods 42 are caused to be moved into the first engaged position and the apparatus is ready for later use.

Figure 8:
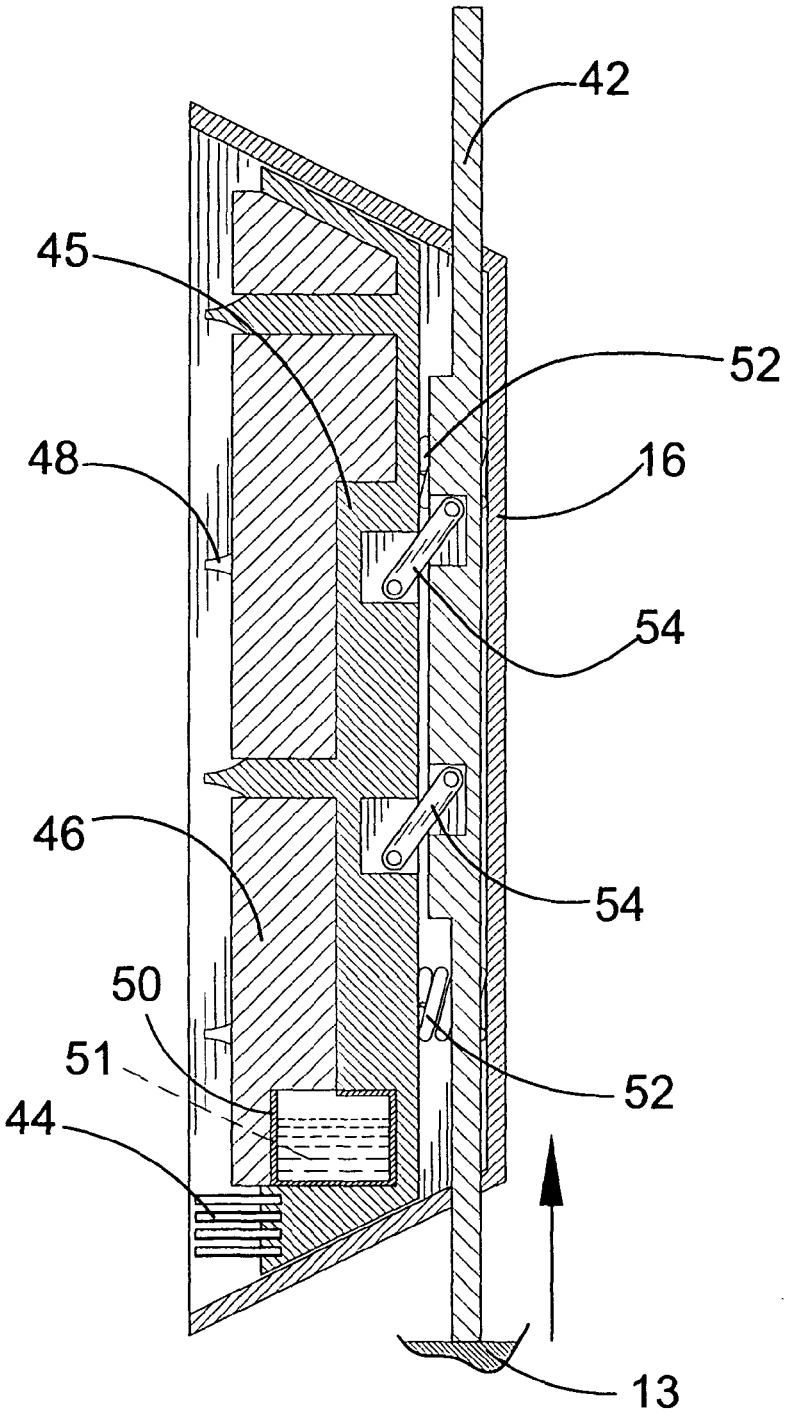
FIG. 8 is a cross-sectional view of the cleaning assembly of the window cleaning apparatus of the present invention in the disengaged position.
Figure 9:
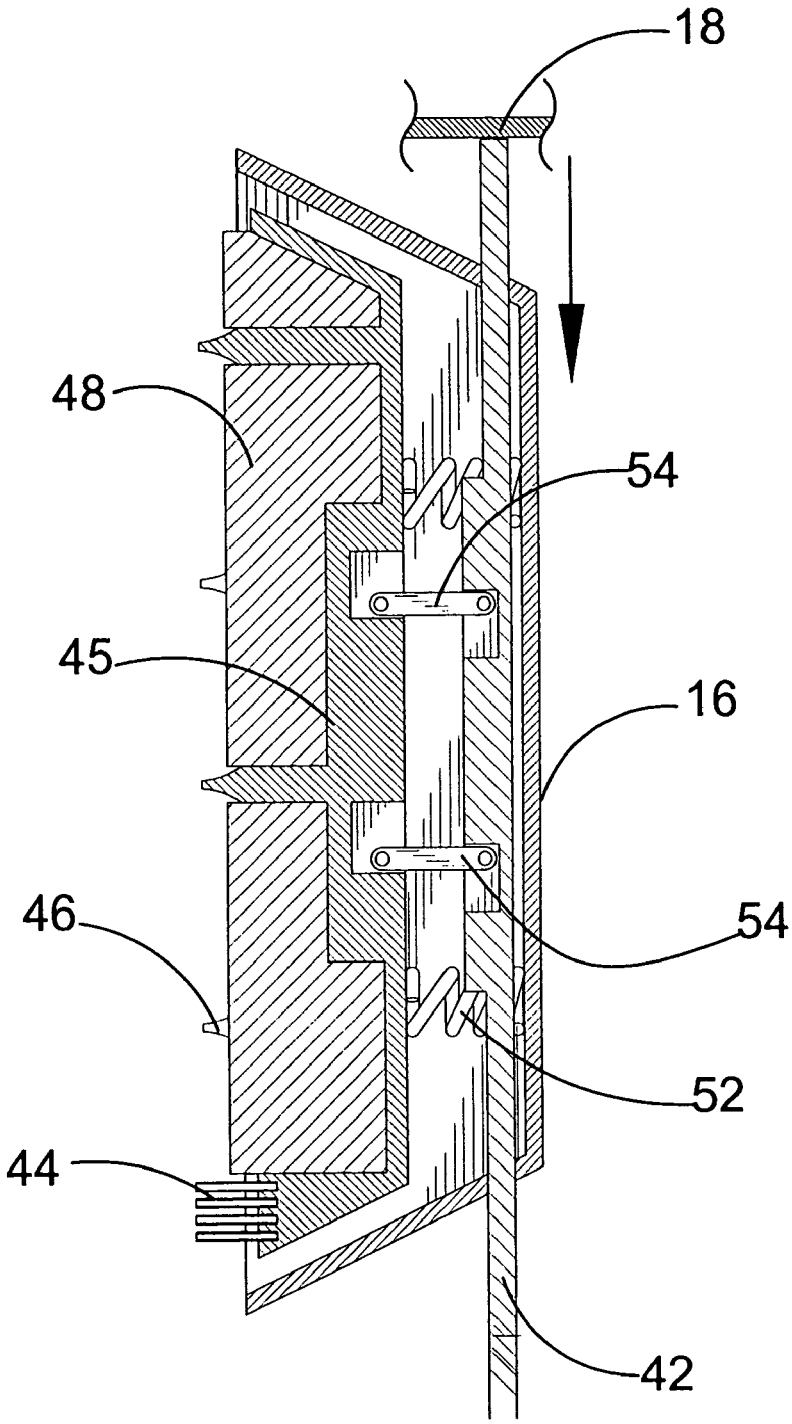
FIG. 9 is a cross-sectional view of the cleaning assembly of the window cleaning apparatus of the present invention in the engaged position.

FIG. 7 is a front view of the cleaning tools of the cleaning assembly 16 engaging the window pane 14 of the window cleaning apparatus of the present invention. The cleaning assembly 16 includes a plurality of cleaning tools for removing dirt, cleaning, and drying the window pane 14. The cleaning tools include at least one of cleaning brushes 44, a sponge 46, and drying elements 48. Also shown in FIG. 7 a plurality of dispensing jets 22 are provided. The cleaning tools are held in position within the cleaning assembly by a second housing 45 as shown in FIGS. 8 and 9. The cleaning brushes 44 are positioned at a first end of the second housing 45 of the cleaning assembly. The dispensing jets 22 are positioned behind the cleaning brushes 44 and dispense cleaning fluid on the cleaning brushes 44 as well as on the surface of the window pane 14. The sponge 46 is positioned above the cleaning brushes 44 and the dispensing jets 22. The sponge 46 washes away any dirt located on the window pane 14 as well as absorbs the cleaning fluid that was dispensed by the dispensing jets 22. The drying elements 48 are preferably two rubber elongated squeegees, similar to windshield wiper blades, and are positioned on a side of the sponge opposite the cleaning brushes 44. Preferably, two drying elements 48 are provided to ensure that any excess cleaning fluid and dirt are removed and the window is dried without streaks. Each of the cleaning brushes 44, the sponge 46, and the drying elements 48 are easily replaceable in order to ensure the window is properly cleaned upon using the window cleaning apparatus of the present invention.

FIG. 7 further shows the rods 42 which extend through the cleaning assembly 16. The rods 42 cause the cleaning tools of the cleaning assembly to be selectively engaged with the window pane 14 and disengaged from the window pane 14. When the cleaning assembly 16 is stored in the storage compartment 18 the rods 42 are in the first engaged position and the cleaning tools contact the window pane 14. Upon the downward vertical movement of the cleaning assembly 16 via the rollers 17 along the surface of the window pane 14, the cleaning tools clean the surface of the window pane 14. The rods 42 are caused to move into the second disengaged position when the cleaning assembly 16 reaches the base of the window frame 12 thereby preventing contact of the cleaning tools to the window pane 14.

FIG. 8 is a cross-sectional view of the cleaning assembly of the window cleaning apparatus of the present invention in the disengaged position. The cleaning assembly 16 includes a plurality of cleaning tools for removing dirt, cleaning, and drying the window pane 14. The cleaning tools include at least one of cleaning brushes 44, a sponge 46, and drying elements 48. Also shown in FIG. 7 a plurality of dispensing jets 22 are provided. The cleaning tools are held in position within the cleaning assembly by a second housing 45. The cleaning brushes 44 are positioned at a first end of the second housing 45 of the cleaning assembly. The dispensing jets 22 are positioned behind the cleaning brushes 44 and dispense cleaning fluid on the cleaning brushes 44 as well as on the surface of the window pane 14. The sponge 46 is positioned above the cleaning brushes 44 and the dispensing jets 22. The sponge 46 washes away any dirt located on the window pane 14 as well as absorbs the cleaning fluid that was dispensed by the dispensing jets 22. The drying elements 48 are preferably two rubber elongated squeegees, similar to windshield wiper blades, and are positioned on a side of the sponge opposite the cleaning brushes 44. Preferably, two drying elements 48 are provided to ensure that any excess cleaning fluid and dirt are removed and the window is dried without streaks. Each of the cleaning brushes 44, the sponge 46, and the drying elements 48 are easily replaceable in order to ensure the window is properly cleaned upon using the window cleaning apparatus of the present invention.

The second housing 45 is compartmentalized so as to accommodate the cleaning brushes 44, the sponge 46, and the drying elements 48. The second housing 45 further includes a reservoir for storing cleaning fluid that is dispensed by the dispensing jets 22 positioned behind the cleaning brushes. The second housing 45 is connected to the rods 42 by extenders 54 and tension springs 52. As shown in FIG. 8, the rods 42 are in the second disengaged position and the cleaning tools are not in contact with the window pane 14. While in the second disengaged position, the rods 42 cause the extenders to move into a retracted position and thereby overcome a force exerted by the tension spring 52 on the second housing 45 resulting in the cleaning tools being disengaged from the window pane 14. The cleaning tools are in the disengaged position when the cleaning assembly 16 is moving in an upward vertical direction toward the storage compartment 18.

FIG. 9 is a sectional view of the cleaning assembly of the window cleaning apparatus of the present invention in the engaged position. The cleaning assembly 16 includes a plurality of cleaning tools for removing dirt, cleaning, and drying the window pane 14. The cleaning tools include at least one of cleaning brushes 44, a sponge 46, and drying elements 48. Also shown in FIG. 7 a plurality of dispensing jets 22 are provided. The cleaning tools are held in position within the cleaning assembly by a second housing 45 as shown in FIGS. 8 and 9. The cleaning brushes 44 are positioned at a first end of the second housing 45 of the cleaning assembly. The dispensing jets 22 are positioned behind the cleaning brushes 44 and dispense cleaning fluid on the cleaning brushes 44 as well as on the surface of the window pane 14. The sponge 46 is positioned above the cleaning brushes 44 and the dispensing jets 22. The sponge 46 washes away any dirt located on the window pane 14 as well as absorbs the cleaning fluid that was dispensed by the dispensing jets 22. The drying elements 48 are preferably two rubber elongated squeegees, similar to windshield wiper blades, and are positioned on a side of the sponge opposite the cleaning brushes 44. Preferably, two drying elements 48 are provided to ensure that any excess cleaning fluid and dirt are removed and the window is dried without streaks. Each of the cleaning brushes 44, the sponge 46, and the drying elements 48 are easily replaceable in order to ensure the window is properly cleaned upon using the window cleaning apparatus of the present invention.

The second housing 45 is compartmentalized so as to accommodate the cleaning brushes 44, the sponge 46, and the drying elements 48. The second housing 45 further includes the reservoir for storing cleaning fluid that is dispensed by the dispensing jets 22 positioned behind the cleaning brushes. The second housing 45 is connected to the rods 42 by extenders 54 and tension springs 52. FIG. 9 shows the rods 42 in the first engaged position and the cleaning tools contacting the windowpane 14. In the first engaged position, the extenders 54 are caused to be moved into the extended position. Once in the extended position, the extenders 54 are unable to overcome the force exerted by the tension spring 52 on the second housing 45. Upon the tension springs 52 being uncoiled, the cleaning tools contact the window pane 14. The cleaning tools are in the engaged position when the cleaning assembly 16 is moving in a downward vertical direction toward the base of the window frame 12 after the window cleaning apparatus 10 of the present invention has been activated.

Figure 10:
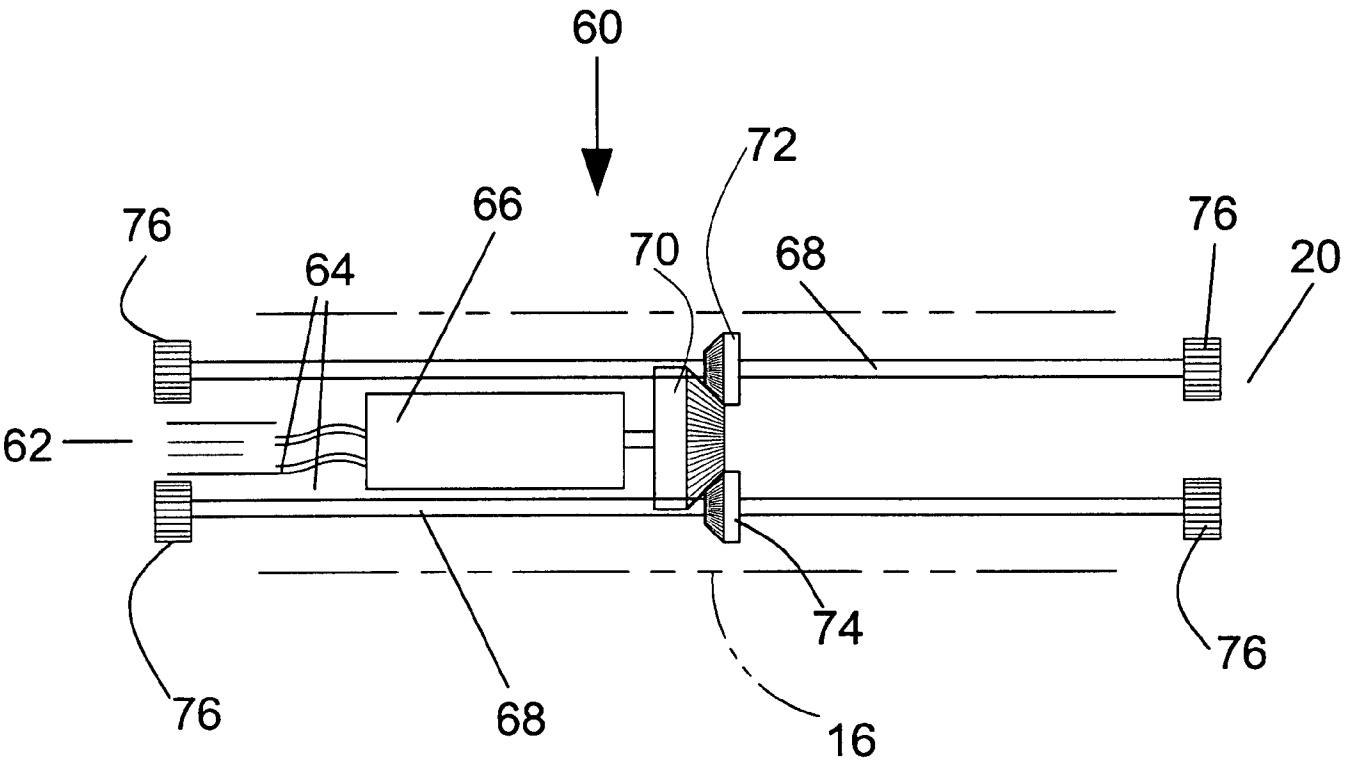
FIG. 10 is an illustrative view of the window cleaning apparatus of the present invention including an internal motor.

FIG. 10 is an illustrative view of the window cleaning apparatus of the present invention including an internal motor. As discussed above with reference to FIGS. 4 and 5, an external motor preferably positioned within a structure is used to control the movement of the cleaning assembly 16 along the guide tracks 20 mounted within a window frame 12. Alternatively, the cleaning assembly 16 can include an internal motor 60 for controlling the movement of the cleaning assembly 16. The cleaning assembly 16 of the window cleaning apparatus must still be externally controlled and activated. However, the cleaning apparatus 10 can be controlled by a user defined control system such as a timer system or by selective one-time activation from the interior of the structure. These methods of activating the window cleaning apparatus of the present invention are described for purposes of example only and any method to activate the window cleaning apparatus may be used.

The internal motor 60 of the cleaning assembly 16 includes a motor 66 connected to a power source 62 by wires 64. An operation gear is also connected to the motor 66. The operation gear 70 is rotated upon activation of the motor 66. The motor 66 and operation gear 70 are positioned between two drive shafts 68. Each drive shaft 68 includes a central drive gear 72 position at a mid point of the drive shaft 68. Teeth on the central drive gear 72 mesh with teeth on the operation gear 70 connected to the motor 66. Each drive shaft 68 further includes distal drive gears positioned at each distal end thereof.

Upon activation of the motor 66, the operation gear is caused to rotate about an axis in a first direction. The rotation of the operation gear 70 caused the central drive gears 72 to rotate the drive shaft 68. The rotation of the drive shaft 68 causes the distal drive gears to rotate and cause a movement mechanism, such as the rollers 17, to move along the guide track 20 thereby moving the cleaning assembly along the window pane 14. The rollers 17 are described here for purposes of example only and any movement mechanism that allows the cleaning assembly to move along the length of the guide tracks may be used. The motor 66 can also rotate the operation gear 70 in the opposite direction thereby causing the central drive gears to rotate the drive shaft and cause the cleaning assembly to move in an opposite direction.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An apparatus for cleaning a window of a structure, said apparatus comprising:

a) a cleaning assembly;

b) a first guide track mounted on one side of a window frame;

c) a second guide track mounted on a side of the window frame opposite said first guide track wherein said cleaning assembly is retained and guided between and along a length of the first and second guide tracks; and d) means for selectively moving said cleaning assembly along the length of said guide track and over a surface of a window within the window frame, wherein said cleaning assembly engages and cleans the surface of the window, wherein said cleaning assembly includes cleaning tools and an interior housing for retaining said cleaning tools therein and said cleaning tools are disengaged from the window when said cleaning assembly is at a second end opposite a first end of the window frame; and wherein each of said first and second guides tracks have a channel extending along a length thereof;

wherein said cleaning assembly further includes rollers on either side thereof received within said channels of said first and second guide tracks for moving said cleaning assembly therealong; and wherein said means for selectively moving said cleaning assembly comprises:

e) a rod;

f) a bearings positioned at each distal end of said rod;

g) a lowering mechanism connected at a first end to and coiled around said rod and connected at a second end to said rollers; and h) a bidirectional motor, wherein upon activation of said bidirectional motor, said rod is rotated in a first direction about said bearing whereby said lowering mechanism uncoils from said rod causing moves said rollers to roll along said channels of said first and second guide tracks in a direction away from said rod, and upon reactivating said bidirectional motor, said rod is rotated in a direction opposite said first direction causing said lowering mechanism to be recoiled around said rod and said rollers to roll along said channels of said first and second guide track in a direction towards said rod.

2. The apparatus as recited in claim 1, wherein said cleaning tools include at least one of nozzles for spraying cleaning fluid on the window, a squeegee for remaining cleaning fluid from the window and a sponge for drying the window.

3. The apparatus as recited in claim 2, wherein said cleaning assembly further comprises a first rod and a second rod positioned at and extending through said cleaning assembly at each distal end thereof.

4. The apparatus as recited in claim 3, wherein said apparatus further comprises means for connecting said interior housing to said first and second rods.

5. The apparatus as recited in claim 4, wherein said connecting means includes at least one of a plurality of extenders and a plurality of tension springs.

6. The apparatus as recited in claim 5, wherein said first and second rods selectively engage said cleaning tools with the surface of the window.

7. The apparatus as recited in claim 6, wherein said cleaning tools are engaged with the window when said cleaning assembly is positioned at a first end of a window frame.

8. The apparatus as recited in claim 1, wherein said cleaning assembly further includes dispensing jets positioned at a first end thereof for dispensing cleaning fluid therefrom and on the window.

9. The apparatus as recited in claim 1, wherein said cleaning tools include at least one of a brush, a sponge, and a plurality of drying elements.

10. The apparatus as recited in claim 9, wherein said drying elements are squeegees.

11. The apparatus as recited in claim 1, further comprising a storage compartment positioned at a first end of a window frame for selectively storing said cleaning assembly therein.

* * * * *